US006910597B2

(12) United States Patent
Iskra

(10) Patent No.: US 6,910,597 B2
(45) Date of Patent: Jun. 28, 2005

(54) COLLECTION CONTAINER ASSEMBLY

(75) Inventor: Michael Iskra, Bridgewater, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 81 days.

(21) Appl. No.: 10/641,879

(22) Filed: Aug. 15, 2003

(65) Prior Publication Data

US 2004/0050846 A1 Mar. 18, 2004

Related U.S. Application Data

(60) Division of application No. 09/933,653, filed on Aug. 21, 2001, now Pat. No. 6,651,835, which is a continuation-in-part of application No. 09/625,287, filed on Jul. 25, 2000, now Pat. No. 6,354,452.

(51) Int. Cl.[7] ..... B65D 25/00

(52) U.S. Cl. ..... 220/23.87; 220/592.2; 215/247; 215/12.1; 215/13.1; 422/105

(58) Field of Search ..... 220/23.87, 592.2; 422/102, 58, 104; 215/247, 12.1, 13.1

(56) References Cited

U.S. PATENT DOCUMENTS

| | | | | |
|---|---|---|---|---|
| 2,072,630 A | 3/1937 | Ferry | 215/12.1 |
| 2,492,152 A | 12/1949 | Hollowell | 47/80 |
| 3,039,648 A | 6/1962 | Busch | 252/62.51 R |
| 3,225,954 A | 12/1965 | Herrick et al. | 220/892.2 |
| 3,578,197 A | 5/1971 | Taylor | 220/892.23 |
| 4,473,161 A | 9/1984 | Zimmerman | 220/892.27 |
| 4,756,407 A | 7/1988 | Larsen | 206/37 |
| 4,830,217 A | 5/1989 | Dufresne et al. | 220/420 |
| 4,865,014 A | 9/1989 | Nelson | 220/392.27 |
| 4,967,919 A | 11/1990 | Garhart | 215/247 |
| 5,232,111 A | 8/1993 | Burns | 215/247 |
| 5,377,854 A | 1/1995 | Cusack | 215/364 |
| 5,699,923 A | 12/1997 | Burns | 215/247 |
| 5,738,233 A | 4/1998 | Burns | 215/247 |
| 5,871,700 A | 2/1999 | Konrad | 422/102 |
| 5,924,594 A | 7/1999 | Kelly | 220/737 |
| 5,942,191 A | 8/1999 | Conway | 422/102 |
| 5,975,343 A | 11/1999 | Kelly et al. | 220/737 |

*Primary Examiner*—Joseph Man-Fu Moy

(57) ABSTRACT

The present invention is a container assembly that includes an inner tube formed from a plastic that is substantially inert to bodily fluids and an outer tube that is formed from a different plastic. Collectively, the container assembly is useful for providing an effective barrier against gas and water permeability in the assembly and for extending the shelf-life of the container assembly, especially when used for blood collection. The inner container is spaced from the outer container at most locations. However, the inner container includes an enlarged top configured to engage the outer container. The enlarged top has a roughened outer surface to permit an escape of air from the space between the containers.

12 Claims, 5 Drawing Sheets

COLLECTION CONTAINER ASSEMBLY

RELATED APPLICATIONS

This application is a divisional application of Ser. No. 09/933,653 filed on Aug. 21, 2001 now U.S. Pat. No. 6,651,835, which is a continuation in part of Ser. No. 09/625,287 filed on Jul. 25, 2000, now U.S. Pat. No. 6,354,452.

BACKGROUND OF THE INVENTION

1. Field of the Invention

The invention relates to a collection container assembly that includes a plurality of nested containers formed from different respective materials and provides an effective barrier against water and gas permeability and for extending the shelf-life of assembly especially when used for blood collection.

2. Description of the Related Art

Plastic tubes contain an inherent permeability to water transport due to the physical properties of the plastic materials used in manufacturing tubes. Therefore, it is difficult to maintain the shelf-life of plastic tubes that contain a liquid additive. It is also appreciated that deterioration of the volume and concentration of the liquid additive may interfere with the intended use of the tube.

In addition, plastic tubes that are used for blood collection require certain performance standards to be acceptable for use in medical applications. Such performance standards include the ability to maintain greater than about 90% original draw volume over a one-year period, to be radiation sterilizable and to be non-interfering in tests and analysis.

Therefore, a need exists to improve the barrier properties of articles made of polymers and in particular plastic blood collection tubes wherein certain performance standards would be met and the article would be effective and usable in medical applications. In addition, a need exists to preserve the shelf-life of containers that contain liquid additives. The time period for maintaining the shelf-life is from manufacturing, through transport and until the container is actually used.

Some prior art containers are formed as an assembly of two or more nested containers. The nested containers are formed from different respective materials, each of which is selected in view of its own unique characteristics. Some nestable containers are dimensioned to fit closely with one another. Containers intended for such assemblies necessarily require close dimensional tolerances. Furthermore, air trapped between the two closely fitting nestable containers can complicate or prevent complete nesting. Some prior art container assemblies have longitudinal grooves along the length of the outer surface of the inner container and/or along the length of inner surface of the outer container. The grooves permit air to escape during assembly of the containers. However, the grooves complicate the respective structures and the grooved containers still require close dimensional tolerances.

Other container assemblies are dimensioned to provide a substantially uniform space at all locations between nested inner and outer containers. Air can escape from the space between the dimensionally different containers as the containers are being nested. Thus, assembly of the nestable containers is greatly facilitated. Additionally, the nestable containers do not require close dimensional tolerances. However, the space between the inner and outer containers retains a small amount of air and the air may be compressed slightly during final stages of nesting. Some such container assemblies are intended to be evacuated specimen collection containers. These container assemblies are required to maintain a vacuum after extended periods in storage. However, air in the space between the inner and outer containers is at a higher pressure than the substantial vacuum in the evacuated container assembly. This pressure differential will cause the air in the space between the inner and outer containers to migrate through the plastic wall of the inner container and into the initially evacuated space of the inner container. Hence, the effectiveness of the vacuum in the container assembly will be decreased significantly. These problems can be overcome by creating a pressure differential between the annular space and the inside of the inner container to cause a migration of air through the walls of the inner container. The inner container then is evacuated and sealed. This approach, however, complicates and lengthens an otherwise efficient manufacturing cycle.

SUMMARY OF THE INVENTION

The present invention is a container assembly comprising inner and outer containers that are nested with one another. The inner and outer containers both are formed from plastic materials, but preferably are formed from different plastic materials. Neither plastic material is required to meet all of the sealing requirements for the container. However, the respective plastic materials cooperate to ensure that the assembly achieves the necessary sealing, adequate shelf life and acceptable clinical performance. One of the nested containers may be formed from a material that exhibits acceptable vapor barrier characteristics, and the other of the containers may be formed from a material that provides a moisture barrier. The inner container also must be formed from a material that has a proper clinical surface for the material being stored in the container assembly. Preferably, the inner container is formed from polypropylene (PP), and the outer container is formed from polyethylene terephthalate (PET).

The inner and outer containers of the container assembly preferably are tubes, each of which has a closed bottom wall and an open top. The outer tube has a substantially cylindrical side wall with a selected inside diameter and a substantially spherically generated bottom wall. The inner tube has an axial length that is less than the outer tube. As a result, a closure can be inserted into the tops of the container assembly for secure sealing engagement with portions of both the inner and outer tubes. The bottom wall of the inner tube is dimensioned and configured to nest with or about the bottom wall of the outer tube. Additionally, portions of the inner tube near the open top are configured to nest closely or have an interference fit with the outer tube. However, portions of the inner tube between the closed bottom and the open top are dimensioned to provide a continuous circumferential clearance between the tubes. The close nesting or interference fit of the inner tube with the outer tube adjacent the open top may be achieved by an outward flare of the inner tube adjacent the open top. The flare may include a cylindrically generated outer surface with an outside diameter approximately equal to or greater than the inside diameter of the side wall of the outer tube. The flare further includes a generally conically tapered inner surface configured for tight sealing engagement with a rubber closure.

The cylindrically generated outer surface of the inner tube may be roughened to define an array of peaks and valleys. The maximum diameter defined by the peaks may be equal to or slightly greater than the inside diameter of the outer tube. Hence, the peaks on the roughened cylindrically generated outer surface of the flared top on the inner tube will provide secure engagement between the inner and outer tubes. However, the valleys between the peaks on the roughened cylindrically generated outer surface at the top of the inner tube will define circuitous paths for venting air trapped in the circumferential space between the inner and outer tubes at locations between the flared top of the inner tube and the closed bottom of the outer tube and to prevent liquid from entering the circumferential space between the inner and outer tubes. Liquid is prevented from entering the space between the inner and outer tubes because due to the pore size, viscosity and surface tension of the liquid. As a result, the container assembly achieves efficient nesting without longitudinal grooves and close dimensional tolerances and simultaneously enables evacuation of air from the space between the inner and outer tubes so that a vacuum condition can be maintained within the inner tube for an acceptably long time and prevents liquid from entering the space between the inner and outer tubes.

DETAILED DESCRIPTION

Figure 1:
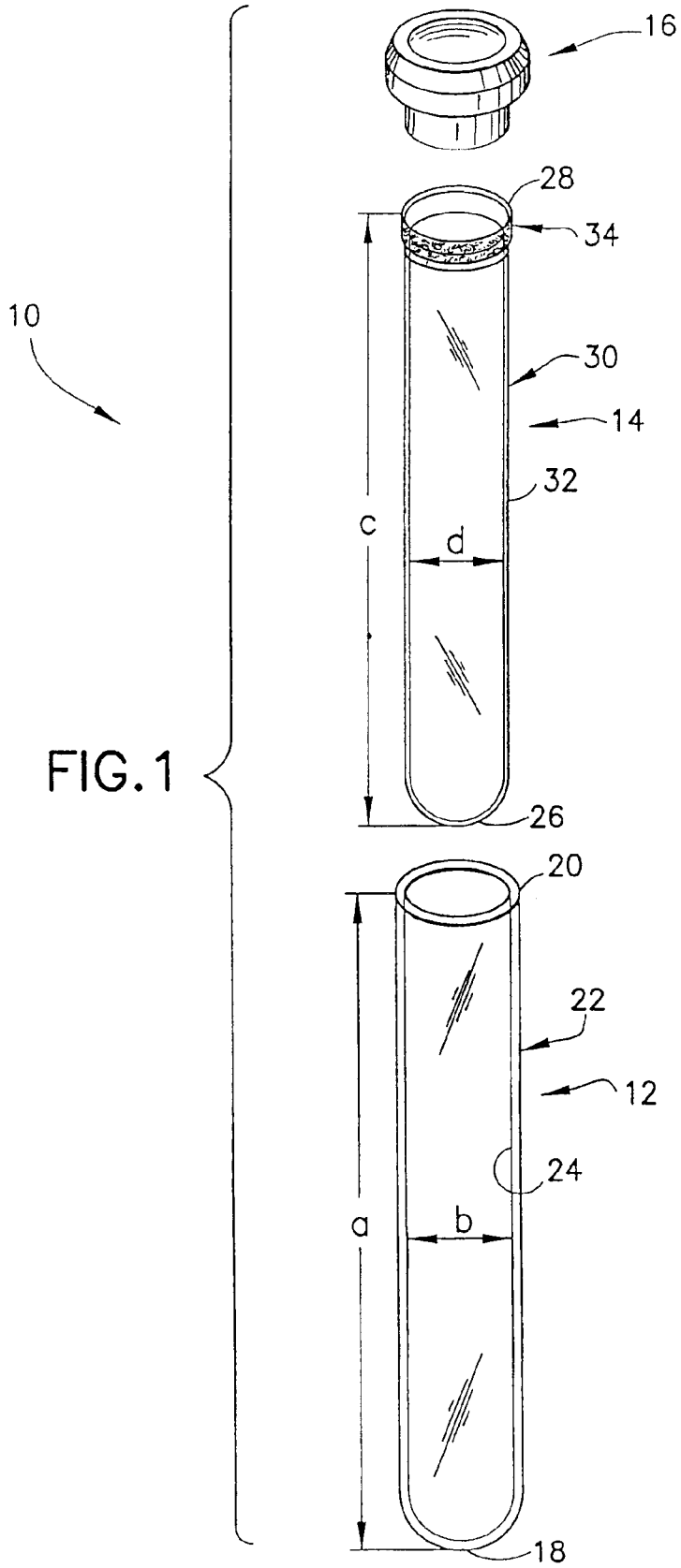
FIG. 1 is an exploded perspective view of the container assembly of the present invention.

As shown in FIGS. 1–6, an assembly 10 includes an outer tube 12, an inner tube 14 and a closure 16.

Outer tube 12 is unitarily formed from PET and includes a spherically generated closed bottom wall 18, an open top 20 and a cylindrical wall 22 extending therebetween whereby side wall 22 slightly tapers from open top 20 to closed bottom wall 18. Outer tube 12 defines a length "a" from the interior of the bottom wall 18 to the open top 20. Side wall 22 of outer tube 12 includes a cylindrically generated inner surface 24 with an inside diameter "b".

Inner tube 14 is unitarily formed from polypropylene and includes a spherically generated closed bottom wall 26, an open top 28 and a cylindrical side wall 30 extending therebetween whereby side wall 30 slightly tapers from open top 28 to closed bottom wall 26. Inner tube 14 defines an external length "c" that is less than internal length "a" of outer tube 12. Side wall 30 of outer tube 14 includes a cylindrical section 32 extending from bottom wall 26 most of the distance to open top 28 of inner tube 14. However, side wall 30 is characterized by a circumferentially enlarged section 34 adjacent open top 28. Enlarged top section 34 of side wall 30 includes an outwardly flared outer surface 36 adjacent cylindrical portions 32 of side wall 30 and a cylindrical outer surface 38 adjacent open top 28 of inner tube 14. Additionally, enlarged top section 34 of side wall 30 includes a conically flared inner surface 40 adjacent open top 28.

Cylindrical portion 32 of side wall 30 of inner tube 14 has an outside diameter "d" that is less than inside diameter "b" of side wall 22 on outer tube 12. In particular, outside diameter "d" of cylindrical portion 32 of side wall 30 is approximately 0.012 inches less than inside diameter "b" of side wall 22 on outer tube 12. As a result, an annular clearance "e" of approximately 0.006 inches will exist between cylindrical portion 32 of side wall 30 of inner tube 14 and side wall 22 of outer tube 12 as shown most clearly in FIG. 3.

Cylindrical outer surface 38 of enlarged top section 34 on side wall 30 is roughened to define an array of peaks and valleys. Preferably, the roughened side wall is formed by an electrical discharge machining process so as to form an electrical discharge machining finish. The finished part then is compared visually with a visual standard, such as the Charmilles Technologies Company visual surface standard (Charmilles Technology Company, Lincolnshire, Ill.). Using this standard practice, roughened cylindrical outer surface 38 of enlarged top section 34 on side wall defines a finish of 1.6 to 12.5 microns and more preferably a finish of 4.5 to 12.5 microns. Additionally, the roughened cylindrical outer surface 38 should be cross-referenced visually to a Charmilles finish number between 24 and 42 and more preferably between 30 and 42.

Figure 3:
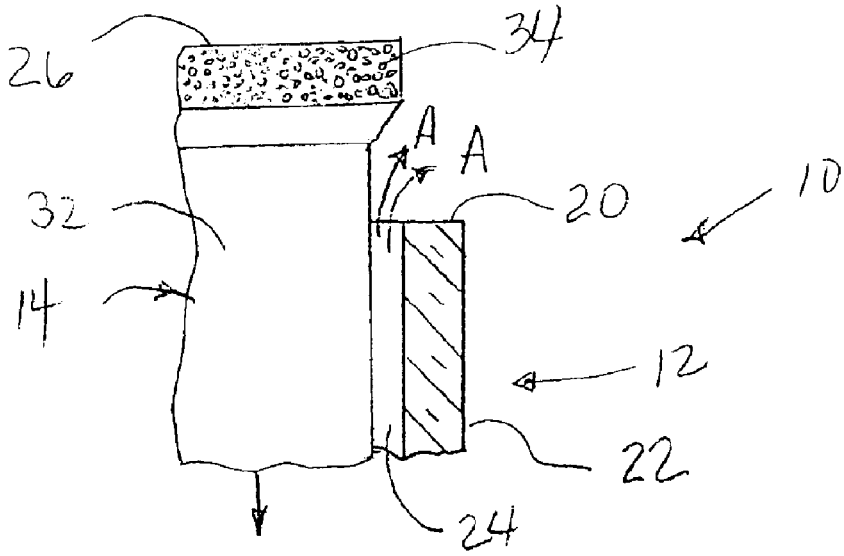
FIG. 3 is a cross-sectional view taken along line 3—3 in FIG. 2.

The peaks on roughened cylindrical outer surface 38 of enlarged top section 34 on side wall 30 define an outside diameter "f" which is approximately equal to or slightly greater than inside diameter "b" of side wall 22 of outer tube 12. Hence, roughened cylindrical outer surface 38 of enlarged top section 34 will telescope tightly against cylindrical inner surface 24 of side wall 22 of outer tube 12 as shown in FIG. 3. Enlarged top section 34 of inner tube 12 preferably defines a length "g" that is sufficient to provide a stable gripping between outer tube 12 and inner tube 14 at enlarged top section 34. In particular, a length "g" of about 0.103 inches has been found to provide acceptable stability.

Closure 16 preferably is formed from rubber and includes a bottom end 42 and a top end 44. Closure 16 includes an external section 46 extending downwardly from top end 44. External section 46 is cross-sectionally larger than outer tube 12, and hence will sealingly engage against open top end 20 of outer tube 12. Closure 16 further includes an internal section 48 extending upwardly from bottom end 42. Internal section 48 includes a conically tapered lower portion 50 and a cylindrical section 52 adjacent tapered section 50. Internal section 48 defines an axial length "h" that exceeds the difference between internal length "a" of outer tube 12 and external length "c" of inner tube 14. Hence, internal section 48 of closure 16 will engage portions of outer tube 12 and inner tube 14 adjacent the respective open tops 20 and 28 thereof, as explained further below. Internal section 52 of closure 16 is cross-sectionally dimensioned to ensure secure sealing adjacent open tops 22 and 28 respectively of outer tube 12 and inner tube 14.

Figure 2:
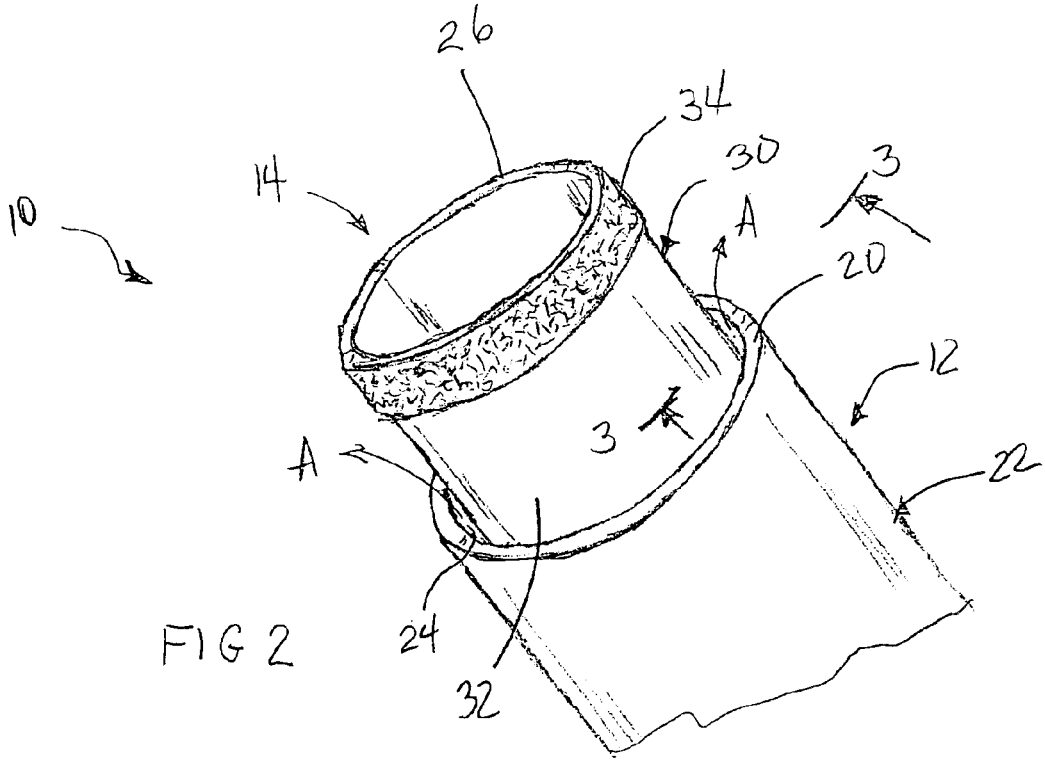
FIG. 2 is a perspective view of the inner and outer containers at a first stage during their assembly.
Figure 4:
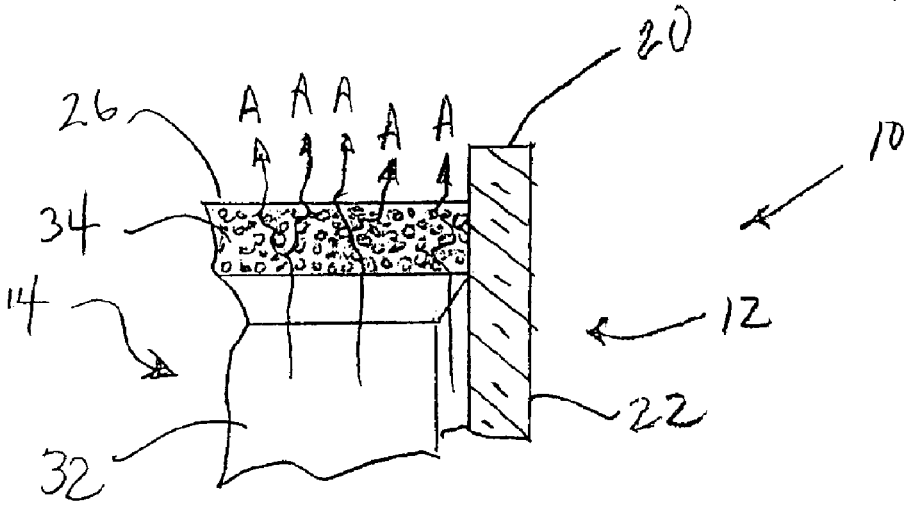
FIG. 4 is a cross-sectional view similar to FIG. 3, but showing a later stage during assembly of the inner and outer containers.
Figure 5:
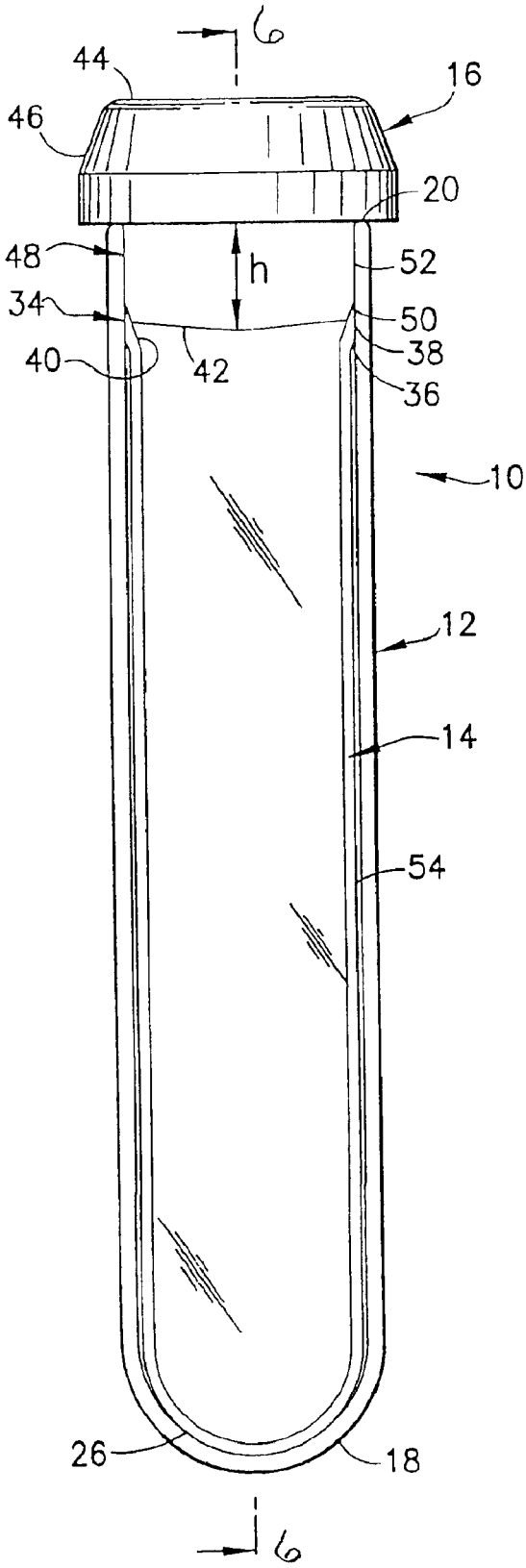
FIG. 5 is a side elevational view of the container assembly of FIG. 1 in its assembled condition.
Figure 6:
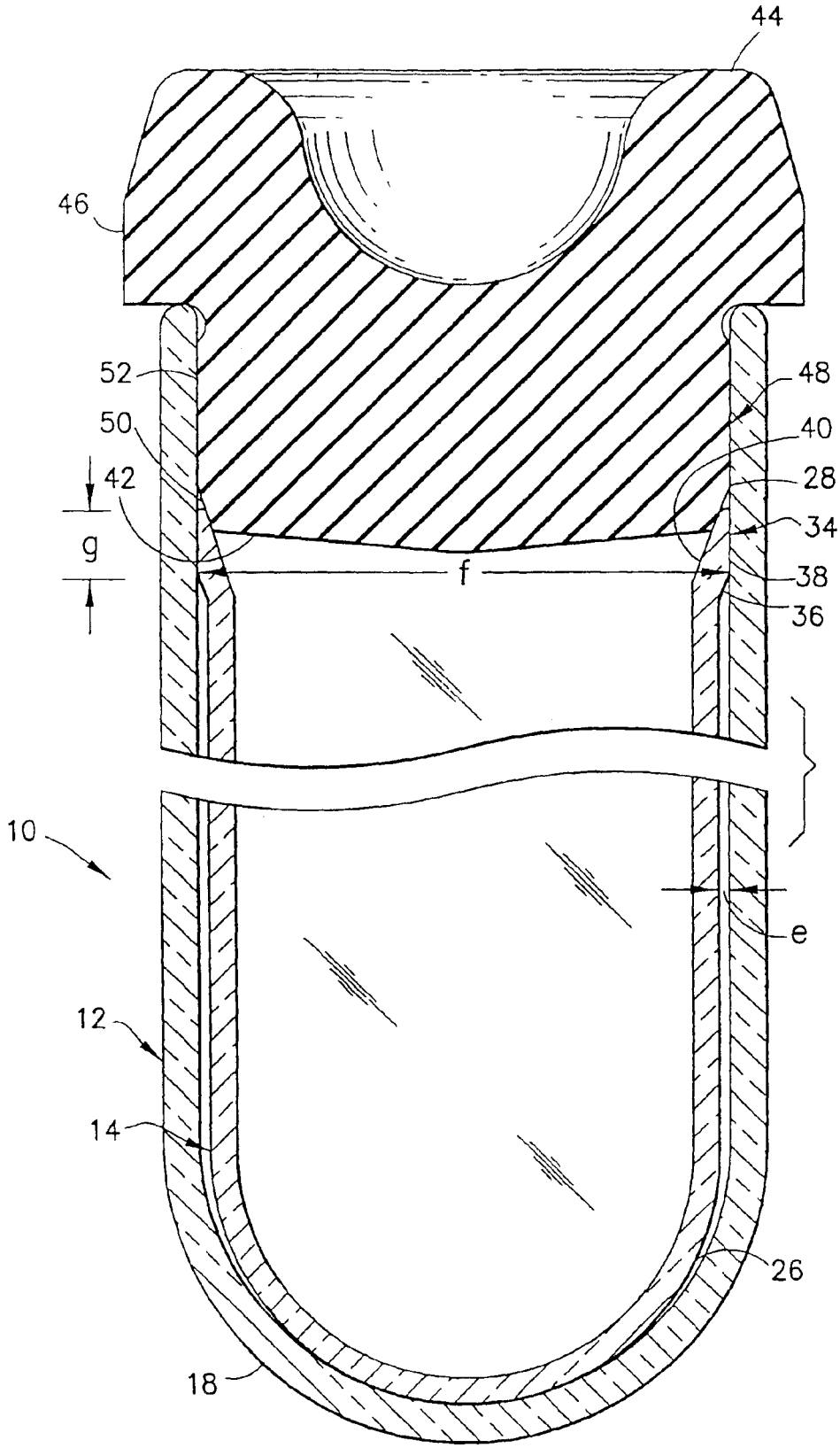
FIG. 6 is a cross-sectional view taken along line 6—6 of FIG. 5.

Assembly 10 is assembled by slidably inserting inner tube 14 into open top 20 of outer tube 12, as shown in FIGS. 2–4. The relatively small outside diameter "d" of cylindrical portion 32 of side wall 30 permits insertion of inner tube 14 into outer tube 12 without significant air resistance. Specifically, air in outer tube 12 will escape through the cylindrical space 54 between cylindrical portion 32 of side wall 30 of inner tube 14 and cylindrical inner surface 24 of outer tube 12, as shown by the arrow "A" in FIG. 3. This relatively easy insertion of inner tube 14 into outer tube 12 is achieved without an axial groove in either of the tubes. The escape of air through the cylindrical space 54 is impeded when enlarged top section 34 of inner tube 14 engages side wall 22 of outer tube 12. However the roughening provided on cylindrical outer surface 38 of enlarged top section 34 defines an array of peaks and valleys. The peaks define the outside diameter "f" and hence define portions of cylindrical outer surface 38 that will engage cylindrical inner surface 24 of side wall 22 of outer tube 12. Roughening to a Charmilles finish number between 30 and 42 provides a sufficient density of peaks to grip cylindrical inner surface 24 of outer tube 12. The valleys between the peaks of roughened cylindrical outer surface 38 are spaced from cylindrical inner surface 24 of side wall 22 of outer tube 12. Hence, the valleys between the peaks on roughened cylindrical outer surface 38 define circuitous passages that permit an escape of air from the circumferential space as indicated by arrow "A" in FIG. 4. Insertion of inner tube 14 into outer tube 12 continues with little air resistance until the outer surface of spherically generated bottom wall 26 of inner tube 12 abuts the inner surface of bottom wall 18 on outer tube 12 in an internally tangent relationship. In this condition, as shown most clearly in FIGS. 5 and 6, inner tube 14 is supported by the internally tangent abutting relationship of bottom wall 26 of inner tube 14 with bottom wall 18 of outer tube 12. Additionally, inner tube 14 is further supported by the circumferential engagement of outer circumferential surface 38 of enlarged top section 34 with inner circumferential surface 24 of side wall 22 on outer tube 12. Hence, inner tube 14 is stably maintained within outer tube 12 with little or no internal movement that could be perceived as a sloppy fit. This secure mounting of inner tube 14 within outer tube 12 is achieved without a requirement for close dimensional tolerances along most of the length of the respective inner and outer tubes 14 and 12 respectively.

Cylindrical space 54 is defined between inner tube 14 and outer tube 12 along most of their respective lengths. Air will exist in cylindrical space 54. However, the air will not be in a compressed high pressure state. Accordingly, there will not be a great pressure differential between cylindrical space 54 and the inside of inner tube 14, and migration of air through the plastic material of side wall 30 of inner tube 14 will not be great. Migration of air through side wall 30 of inner tube 14 can be reduced further by evacuating cylindrical space 54. More particularly, the assembly of outer and inner tubes 12 and 14 can be placed in a low pressure environment. The pressure differential will cause air in cylindrical space 54 to traverse the circuitous path of valleys between the peaks of roughened outer cylindrical surface 38 to the lower pressure ambient surroundings.

The assembly of inner tube 14 with outer tube 12 can be sealed by stopper 16. In particular, tapered portion 50 of internal section 48 facilitates initial insertion of stopper 16 into open top 20 of outer tube 12. Sufficient axial advancement of stopper 16 into open top 20 will cause cylindrical outer surface 52 of internal section 48 to sealingly engage internal surface 24 of outer tube 12. Further insertion will cause tapered surface 50 of internal section 48 to sealingly engage tapered internal surface 40 of enlarged section 34 of inner tube 14. Hence, closure 16 securely seals the interior of inner tube 14 and cylindrical space 54 between inner tube 14 and outer tube 12.

While the invention has been defined with respect to a preferred embodiment, it is apparent that changes can be made without departing from the scope of the invention as defined by the appended claims.

What is claimed is:

1. A container assembly comprising an outer container formed from a first plastic material and having a bottom, an open top and a side wall extending therebetween, an inner container formed from a second plastic material and having a bottom, an open top and a side wall extending therebetween, said side wall of said inner tube having an enlarged top section adjacent said open top, said enlarged top section disposed in secure engagement with said side wall of said outer tube, wherein portions of the inner container between the bottom and the enlarged top section are spaced inwardly from the side wall of the outer container to define a cylindrical space therebetween.

2. The container assembly of claim 1, wherein the outer container is formed from a plastic material that is a vapor barrier, and wherein the inner container is formed from a plastic material that is a moisture barrier.

3. The container assembly of claim 1, wherein the inner container is formed from polypropylene.

4. The container assembly of claim 3, wherein the outer container is formed from PET.

5. The container assembly of claim 1, wherein the side wall of the inner container is flared outwardly adjacent the open top of the inner container for supporting engagement with the side wall of the outer container.

6. The container assembly of claim 1, wherein the side wall of the inner container is shorter than the side wall of the outer container, such that the open top of the inner container is spaced inwardly from the open top of the outer container.

7. The container assembly of claim 6, further comprising a closure sealingly engaged the open tops of the inner and outer containers.

8. The container assembly of claim 1, wherein the first and second containers are substantially cylindrical tubes.

9. The container assembly of claim 1, wherein the cylindrical space between the inner and outer tubes defines a radial thickness of approximately 0.006".

10. The container assembly of claim 1, wherein the enlarged top section of the inner tube comprises a cylindrical outer surface having an axial length of about 0.103".

11. The container assembly of claim 1, wherein the enlarged section of the inner tube includes a conically flared inner surface.

12. The container assembly of claim 7, wherein the closure is dimensioned for sealingly engaging portions of the side wall of the outer tube adjacent the open top thereof and portions of the side wall of the inner tube adjacent the open top thereof.

* * * * *